US008896588B2

(12) United States Patent
Yamagishi

(10) Patent No.: US 8,896,588 B2
(45) Date of Patent: Nov. 25, 2014

(54) LIQUID CRYSTAL DISPLAY DEVICE

(71) Applicant: Japan Display East Inc., Mobara (JP)

(72) Inventor: Yasuhiko Yamagishi, Mobara (JP)

(73) Assignee: Japan Display Inc., Tokyo (JP)

( * ) Notice: Subject to any disclaimer, the term of this patent is extended or adjusted under 35 U.S.C. 154(b) by 96 days.

(21) Appl. No.: 13/648,306

(22) Filed: Oct. 10, 2012

(65) Prior Publication Data

US 2013/0088476 A1 Apr. 11, 2013

(30) Foreign Application Priority Data

Oct. 11, 2011 (JP) ..... 2011-223786

(51) Int. Cl.
*G09G 5/00* (2006.01)
*G09G 3/36* (2006.01)

(52) U.S. Cl.
CPC ..... *G09G 3/3648* (2013.01); *G09G 2320/0204* (2013.01); *G09G 3/3614* (2013.01); *G09G 2310/0243* (2013.01); *G09G 3/3655* (2013.01)
USPC ..... 345/212

(58) Field of Classification Search
CPC . G09G 3/3614; G09G 3/3696; G09G 3/3655; G09G 2300/0876; G09G 2310/0204; G09G 2310/0243; G09G 3/3648
USPC ..... 345/211, 212; 349/139
See application file for complete search history.

(56) References Cited

U.S. PATENT DOCUMENTS

2004/0164943 A1* 8/2004 Ogawa et al. ..... 345/92
2004/0169627 A1* 9/2004 Hong ..... 345/89
2007/0002005 A1 1/2007 Kim et al.
2007/0097054 A1* 5/2007 Cheng ..... 345/96
2007/0164947 A1* 7/2007 Lin et al. ..... 345/87
2008/0278429 A1* 11/2008 Chen ..... 345/98
2008/0316161 A1* 12/2008 Song et al. ..... 345/95
2009/0015527 A1* 1/2009 Chung et al. ..... 345/87
2009/0102820 A1* 4/2009 Chen et al. ..... 345/204
2009/0135124 A1* 5/2009 Nakatsuka ..... 345/94
2009/0167659 A1* 7/2009 Kim et al. ..... 345/89
2009/0268115 A1* 10/2009 Hagino ..... 349/39
2009/0278832 A1* 11/2009 Cho et al. ..... 345/211
2009/0315872 A1* 12/2009 Ikeda et al. ..... 345/209
2010/0097365 A1* 4/2010 Fang et al. ..... 345/212
2012/0081352 A1* 4/2012 Yamagishi ..... 345/212

FOREIGN PATENT DOCUMENTS

JP 2009-015334 1/2009

OTHER PUBLICATIONS

Communication in connection with corresponding Japanese Application No. 2011-2233786, mailed Aug. 19, 2014, with English Translation thereof.

* cited by examiner

*Primary Examiner* — Tom Sheng

(74) *Attorney, Agent, or Firm* — Antonelli, Terry, Stout & Kraus, LLP.

(57) ABSTRACT

The liquid crystal display device according to the present invention cancels the fluctuation in the potential of the common voltage so that the image quality of the screen displayed on the liquid crystal display panel can be prevented from deteriorating, and thus, a high quality image can be provided, and adopts a common symmetric method, such as a dot inverting method, as the method for driving the liquid crystal display device.

8 Claims, 11 Drawing Sheets

LIQUID CRYSTAL DISPLAY DEVICE

CROSS-REFERENCE TO RELATED APPLICATION

The present application claims priority over Japanese Patent Application JP2011-223786 filed on Oct. 11, 2011, the contents of which are hereby incorporated into this application by reference.

BACKGROUND OF THE INVENTION (1) Field of the Invention

The present invention relates to a liquid crystal display device, and in particular, to a liquid crystal display device where a common symmetric method, such as a dot inverting method, is adopted as the method for driving the liquid crystal display device.

(2) Description of the Related Art

TFT type liquid crystal display devices where thin film transistors are used as active elements can display images with high definition, and therefore are often used as the display devices for televisions and personal computers.

Liquid crystal display devices basically have a so-called liquid crystal display panel where a liquid crystal layer is sandwiched between two (a pair of) substrates, at least one of which is made of transparent glass or the like, and a predetermined pixel is turned on and off by selectively applying a voltage to various types of electrodes that form pixels on the substrates of this liquid crystal display panel, and thus, the liquid crystal display devices are excellent in contrast performance and high speed display performance.

When the same voltage (direct current voltage) is applied to a liquid crystal layer for a long period of time, the inclination of the liquid crystal layer is fixed, which consequentially causes an afterimage and shortens the life of the liquid crystal layer. In order to prevent this, liquid crystal display devices use an alternating current having a certain period of time for the voltage applied to the liquid crystal layer, that is to say, the voltage applied to pixel electrodes is switched from the positive voltage to the negative voltage or vice versa during a certain period of time with the common voltage (VCOM) supplied to the counter electrodes as a reference.

Two methods, a common symmetric method and a common inverting method, are known as methods for driving the liquid crystal display device according to which an alternating current voltage is applied to the liquid crystal layer (see below Japanese Unexamined Patent Publication 2009-15334).

The common symmetric method is a method for keeping the common voltage (VCOM) supplied to the counter electrodes constant and for inverting the voltage applied to pixel electrodes (that is to say, gradation voltage) to a voltage at a potential higher than the common voltage (VCOM) or to a voltage at a potential lower than the common voltage (VCOM), and a dot inverting method and an n line (two line, for example) inverting method are known as examples of this method.

(Patent Document 1) Japanese Unexamined Patent Publication 2009-15334

SUMMARY OF THE INVENTION

FIG. 11 is a diagram showing the polarities of pixels in a liquid crystal display device when driven in accordance with a dot inverting method.

In the dot inverting method, a pair of adjacent pixels, for example, DR0 (+) and DG0 (−) along line G0, and the other following pairs of pixels have plus (+) and minus (−) polarities, and thus, every pair of adjacent pixels has opposite polarities when the pixels are driven. Here, plus (+) means that a gradation voltage at a potential higher than that for the counter electrodes is applied to a pixel electrode when the gradation voltage is written into the pixel, and minus (−) means that a gradation voltage at a potential lower than that for the counter electrodes is applied to a pixel electrode when the gradation voltage is written into the pixel.

In the next frame, the polarities of the pixels become opposite to those of the previous frame. That is to say, pixels of which the polarity is (+) in the previous frame have a polarity of (−) in the next frame, and pixels of which the polarity is (−) in the previous frame have a polarity of (+) in the next frame.

FIG. 12 is a diagram showing the potentials of the gradation voltages written into the pixels when an image of black-and-white vertical stripes with a width of one dot is displayed on a liquid crystal display panel in accordance with a dot inverting driving method.

Here, the descriptions for FIGS. 11 and 12 are based on the operation in a so-called normally black displaying mode where the greater the difference in the potential between the gradation voltage supplied to the pixels and the common voltage (VCOM) is, the higher the brightness is.

When an image of black-and-white vertical stripes with a width of one dot is displayed on a liquid crystal display panel in accordance with a dot inverting method, as for the polarities of the first pixels, the red pixel DR0 and the blue pixel DB0 are plus (+), and the green pixel DG0 is minus (−). As for the polarities of the second pixels, the red pixel DR1 and the blue pixel DB1 are minus (−), and the green pixel DG1 is plus (+). The effective value of the image voltage for writing into the first pixels (DR0, DG0, DB0) is biased to the plus (+) side relative to the common voltage (VCOM) supplied to the counter electrodes, and the effective value of the voltage for writing into the second pixels (DR1, DG1, DB1) is biased to the minus (−) side relative to the common voltage (VCOM) supplied to the counter electrodes.

Thus, during the process for writing in a gradation voltage to the pixels, the potential of the common voltage (VCOM) is distorted due to the effects of parasitic capacitances in the thin film transistors in the pixels and the voltage for writing in. As a result, the potential of the common voltage (VCOM), which is originally supposed to be a constant voltage, fluctuates as VCOM' shown as the dotted line in FIG. 12, and thus, the common voltage (VCOM) of the counter electrodes in the first pixels (DR0, DG0, DB0) is distorted to the positive side (potential higher than that of VCOM) as a whole where the voltage (ΔV1) for writing into the red and blue pixels (DR0, DB0) has become smaller, and conversely, the potential (ΔV2) for writing into the green pixel (DG0) has become greater.

The effective voltage of the above-described common voltage (VCOM) fluctuates along the line G1, which is the next line after the line G0, in the same manner. Pixels along the line G0 and pixels along the line G1 have opposite polarities, and therefore, the directions in which the potential is distorted are opposite, though the amount of fluctuation of the effective voltage (ΔV) is the same.

When an image of black-and-white vertical stripes is displayed on a liquid crystal display panel, the fluctuation in the above-described common voltage (VCOM) causes the screen on the liquid crystal display panel to look green as a whole, and thus, the image quality deteriorates.

The present invention is provided in order to solve the above-described problems with the prior art, and an object of the present invention is to provide a technology for cancelling the fluctuation in the potential of the common voltage in a liquid crystal display device so that the image quality of the screen displayed on the liquid crystal display panel can be prevented from deteriorating, and thus, a high quality image can be provided.

The above-described and other objects as well as the novel features of the present invention will be clarified by the descriptions of the present specification and the accompanying drawings.

The representative modes of the invention disclosed in the present specification are briefly outlined as follows.

(1) A liquid crystal display device is provided with a liquid crystal display panel having a number of pixels, wherein each of the above-described pixels has a pixel electrode to which an image voltage is supplied and a counter electrode to which a common voltage is supplied, and when two pixels adjacent to each other along one display line are a first pixel and a second pixel, an image voltage at a potential higher than that of the common voltage supplied to the counter electrode is applied to the pixel electrode of the first pixel and an image voltage at a potential lower than that of the common voltage supplied to the counter electrode is applied to the pixel electrode of the second pixel when the image voltage is written into the pixel electrode, and the liquid crystal display device is further provided with: a common voltage generating circuit for generating a common voltage supplied to each of the counter electrodes of the above-described pixels; and a feedback means for detecting a fluctuation in the potential of the common voltage in a number of places within each of the above-described counter electrodes so that the fluctuation is fed back to the above-described common voltage generating circuit, and that on the basis of a fluctuation in the potential that has been fed back by the above-described feedback means, the above-described common voltage generating circuit supplies a common voltage that is gained by superposing a reverse correction voltage for offsetting the above-described fluctuation in the potential on a reference common voltage, which is a common voltage before the above-described fluctuation in the potential is fed back, to the counter electrode.

(2) The liquid crystal display device according to (1) is further provided with a supply end for supplying the above-described common voltage to each of the above-described counter electrodes from the above-described common voltage generating circuit, wherein when point A is located at a distance away from the above-described supply end and point B is located closer to the above-described supply end than point A, the voltage that fluctuates at the above-described point A is voltage A and the voltage that fluctuates as the above-described point B is voltage B, the above-described feedback means detects fluctuations in the potential in two places for the above-described voltage A and the above-described voltage B so that the fluctuations are fed back to the above-described common voltage generating circuit.

(3) In the liquid crystal display device according to (2), the above-described common voltage generating circuit has a mixing means for mixing the above-described voltage A and the above-described voltage B and an amplifier circuit for inverting and amplifying the voltage mixed in the above-described mixing means so that the resulting voltage is superposed on the above-described reference common voltage and is supplied to the above-described counter electrodes.

(4) In the liquid crystal display device according to (3), the direction in which the above-described liquid crystal display panel is scanned vertically is the direction from the above-described point A toward the above-described point B, and the above-described mixing means continuously changes the mixture ratio of the above-described voltage A and the above-described voltage B in such a manner that the above-described voltage A and the above-described voltage B are mixed when having such a relationship as voltage A>voltage B at the beginning of one vertical scan period, and the above-described voltage A and the above-described voltage B are mixed when having such a relationship as voltage A<voltage B as the vertical scan period progresses.

(5) In the liquid crystal display device according to (3), the direction in which the above-described liquid crystal display panel is scanned vertically is the direction from the above-described point A toward the above-described point B, and the above-described mixing means continuously changes the mixture ratio of the above-described voltage A and the above-described voltage B in such a manner that the above-described voltage A and the above-described voltage B are mixed when having such a relationship as voltage A>voltage B at the beginning of one vertical scan period, and the above-described voltage A and the above-described voltage B are mixed when having such a relationship as voltage A<voltage B as the vertical scan period approaches the end.

(6) In the liquid crystal display device according to (4) or (5), the above-described mixing means has a resistor A where the above-described voltage A is inputted at one end, a resistor B where the above-described voltage B is inputted at one end, and a transistor connected between the other end of the above-described resistor A and the other end of the above-described resistor B, the resistance value of the above-described resistor A is higher than the resistance value of the above-described resistor B, the above-described voltage A is inputted into the above-described amplifier circuit through resistor A, the above-described voltage B is inputted into the above-described amplifier circuit through the above-described resistor B and the above-described transistor, and the mixture ratio of the above-described voltage A and the above-described voltage B is changed by changing the gate voltage of the above-described transistor.

(7) In the liquid crystal display device according to (6), the above-described mixture means has a D/A converting circuit for converting the inputted digital control signal into an analog control signal and for inputting the converted analog control signal into the gate of the above-described transistor, and the mixture ratio of the above-described voltage A and the above-described voltage B is changed by changing the gate voltage of the above-described transistor in accordance with the change in the above-described inputted digital control signal.

(8) In the liquid crystal display device according to (4) or (5), the above-described mixing means has a resistor A where the above-described voltage A is inputted at one end, a resistor B where the above-described voltage B is inputted at one end, and a digital control variable resistor which is connected between the other end of the above-described resistor A and the other end of the above-described resistor B and into which the above-described digital control signal is inputted, the resistance value of the above-described resistor A is greater than the resistance value of the above-described resistor B, the above-described voltage A is inputted into the above-described amplifier circuit through the above-described resistor A, the above-described voltage B is inputted into the above-described amplifier circuit through the above-described resistor B and the above-described digital control variable resistor, and the mixture ratio of the above-described voltage A and the above-described voltage B is changed by changing the resistance value of the above-described digital control variable resistor in accordance with the change in the above-described inputted digital control signal.

(9) The liquid crystal display device according to (7) or (8) is further provided with a display control circuit and a power supplying circuit, wherein the above-described common voltage generating circuit is provided within the above-described power supplying circuit, and the above-described display control circuit generates a digital control signal, which is inputted into the above-described common voltage generating circuit within the above-described power supplying circuit.

The effects gained by the representative modes of the invention disclosed in the present specification are briefly outlined as follows.

In the liquid crystal display device according to the present invention, the fluctuation in the potential of the common voltage is cancelled so that the image quality of the screen displayed on the liquid crystal display panel can be prevented from deteriorating, and a high quality image can be provided.

DESCRIPTION OF THE EMBODIMENTS

In the following, the embodiments of the present invention are described in detail in reference to the drawings.

Here, throughout all the diagrams illustrating the embodiments, the same symbols are attached to the components having the same functions, and the same descriptions are not repeated. In addition, the following embodiments do not limit the interpretations of the scope of the present invention.

[Structure of Liquid Crystal Display Device on Basis of which the Present Invention is Made]

Figure 1:
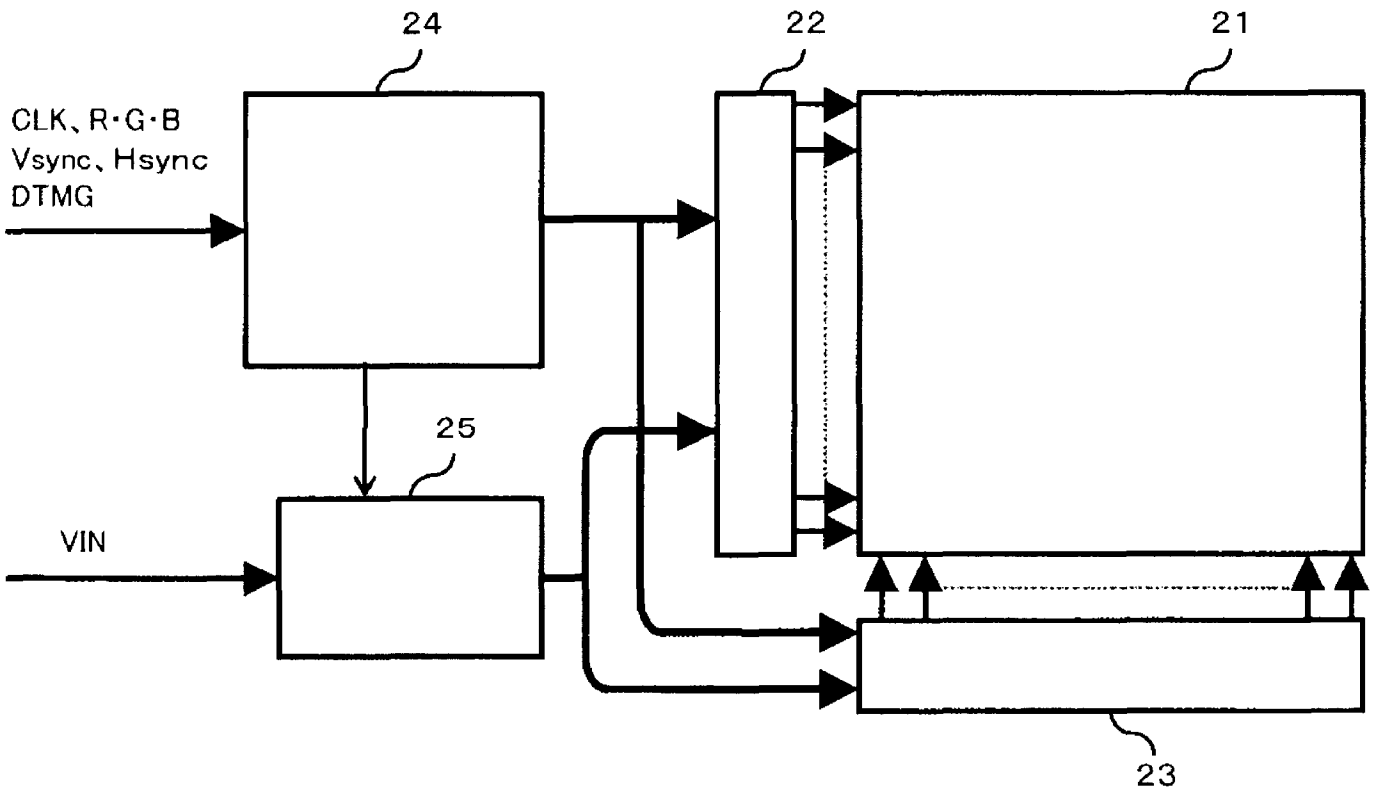
FIG. 1 is a block diagram schematically showing the structure of a liquid crystal display device on the basis of which the present invention is made.

FIG. 1 is a block diagram schematically showing the structure of a liquid crystal display device on the basis of which the present invention is made.

The liquid crystal display device in this example is formed of a liquid crystal display panel 21, a drain driver unit 23, a gate driver unit 22, a display control circuit 24 and a power supply circuit 25.

The drain driver unit 23 is formed of a number of drain drivers, and these drain drivers are provided in a periphery portion of the liquid crystal display panel 21. As an example, the drain drivers are mounted in a periphery portion along one side of the first substrate (glass substrate, for example) from among a pair of substrates of the liquid crystal display panel 21 in accordance with a COG method. Alternatively, the drain drivers are mounted on the flexible circuit board provided in a periphery portion along a side of the first substrate in the liquid crystal display panel 21 in accordance with a COF method.

Likewise, the gate driver unit 22 is formed of a number of gate drivers, and these gate drivers are provided in a periphery portion of the liquid crystal display panel 21. As an example, the gate drivers are mounted in a periphery portion along one side (one side other than the side along which the drain drivers are mounted) of the first substrate (glass substrate, for example) from among a pair of substrates of the liquid crystal display panel 21 in accordance with a COG method. Alternatively, the gate drivers are mounted on the flexible circuit board provided in a periphery portion along one side (one side other than the side along which the drain drivers are mounted) of the first substrate of the liquid crystal display panel 21 in accordance with a COF method.

The display control circuit 24 and the power supply circuit 25 are respectively mounted on a circuit board provided in a periphery portion of the liquid crystal display panel 21 (rear side of the liquid crystal display device, for example).

Display data (R, G, B) and display control signals, such as a clock, a vertical sync signal (Vsync), a horizontal sync signal (Hsync) and a display timing signal (DTMG), are inputted into the display control circuit 24 from the display signal source, such as of a personal computer and a television receiver circuit (host side).

The display control circuit 24 adjusts the timing of display data so that the display data becomes appropriate for the display on the liquid crystal display panel 21, including the conversion of the display data to an alternating current, and inputs the display data that has been converted to that in the display format to the drain drivers in the drain driver unit 23 and the gate drivers in the gate driver unit 22 together with a sync signal (clock signal).

The gate drivers supply a selective scan voltage to the scan lines (also referred to as gate lines: G) one-by-one under the control of the display control circuit 24. In addition, the drain drivers supply a gradation voltage (also referred to as image voltage) to an image line (also referred to as drain line or source line: D) so that an image is displayed. The power supply circuit 25 generates various types of voltages required for the liquid crystal display device on the basis of the input voltage (VIN).

Figure 2:
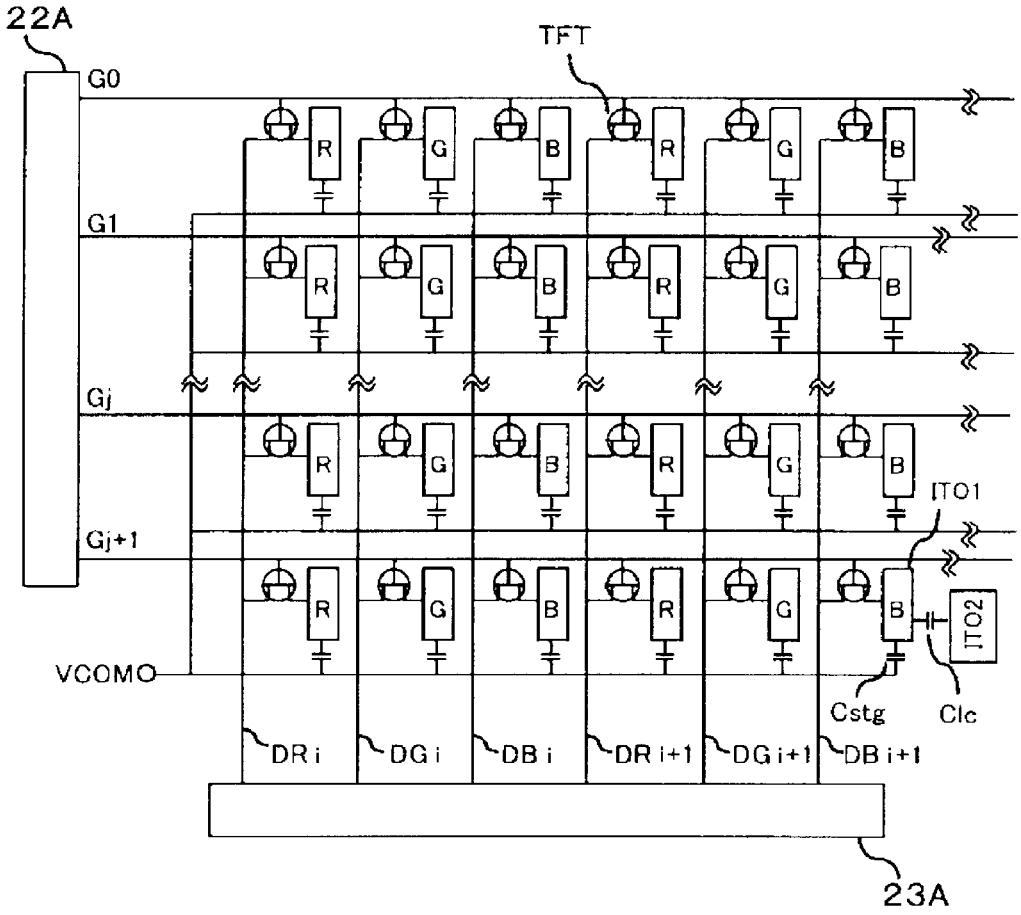
FIG. 2 is a diagram showing an equivalent circuit of an example of the liquid crystal display panel in FIG. 1.

FIG. 2 is a diagram showing an equivalent circuit of an example of the liquid crystal display panel 21 in FIG. 1.

As shown in FIG. 2, the liquid crystal display panel 21 has a number of sub-pixels in such a manner that each sub-pixel is provided in a region between the image lines (D) and the scan lines (G).

The sub-pixels have a thin film transistor (TFT) where the first electrode (drain electrode or source electrode) of the thin film transistor (TFT) is connected to an image line (D) and the second electrode (source electrode or drain electrode) of the thin film transistor (TFT) is connected to a pixel electrode (ITO1). In addition, the gate electrode of the thin film transistor (TFT) is connected to a scan line (G).

In FIG. 2, Clc is a liquid crystal capacitor that equivalently denotes a liquid crystal layer placed between a pixel electrode (ITO1) and a counter electrode (ITO2), and Cstg is a holding capacitor formed between a pixel electrode (ITO1) and a counter electrode (ITO2).

In the liquid crystal display panel 21 in FIG. 2, the first electrodes of the thin film transistors (TFT) in the sub-pixels aligned in a column are respectively connected to image lines (D), and the image lines (D) are connected to the drain driver 23A that supplies a gradation voltage corresponding to the display data to the sub-pixels aligned in a column.

In addition, the gate electrodes of the thin film transistors (TFT) in the sub-pixels aligned in a row are respectively connected to scan lines (G), and the scan lines (G) are connected to the gate driver 22A that supplies a scan voltage (positive or negative bias voltage) to the gates of the thin film transistors (TFT) during one horizontal scan time. Though FIG. 2 shows only one drain driver 23A and only one gate driver 22A, there are actual cases where two or more of these have been provided.

When an image is displayed on the liquid crystal display panel 21, the gate driver 22A selects scan lines (G0, G1 . . . Gj, Gj+1) one-by-one from the top to the bottom (in the order of G0→G1 . . . ). Meanwhile, the drain driver 23A supplies a gradation voltage corresponding to the display data to the image line (D) during the time in which a certain scan line (G) is being selected.

The voltage supplied to an image line (D) is applied to the pixel electrodes (ITO1) through the thin film transistors (TFT), and finally, the holding capacitors (Cstg) and the liquid crystal capacitor (Clc) are charged so that the liquid crystal molecules are controlled to display an image.

The following descriptions are also based on the operation in a so-called normally black displaying mode where the greater the difference in the potential between the gradation voltage supplied to the pixels and the common voltage (VCOM) is, the higher the brightness is.

The liquid crystal display panel 21 is formed by placing a first substrate on which pixel electrodes (ITO1), thin film transistors (TFT) and the like are formed and a second substrate on which color filters and the like are formed so that the first and second substrates overlap with a predetermined distance in between, pasting the two substrates together with a sealing material provided in a frame form in the periphery portion between the two substrates, injecting liquid crystal into the space inside the sealing material between the two substrates through an opening for liquid crystal provided in the sealing material so that the liquid crystal is sealed in, and pasting polarizing plates outside the two substrates.

Here, the counter electrodes (ITO2) are provided on the second substrate in the case where the liquid crystal display panel is of the TN type or of the VA type. The counter electrodes (ITO2) are provided on the first substrate in the case of the IPS type.

Since the present invention does not relate to the internal structure of the liquid crystal display panel, the detailed descriptions of the internal structure of the liquid crystal display panel are omitted. Furthermore, the present invention is applicable to liquid crystal display panels having any structure.

[Features of the Present Invention]

Figure 3:
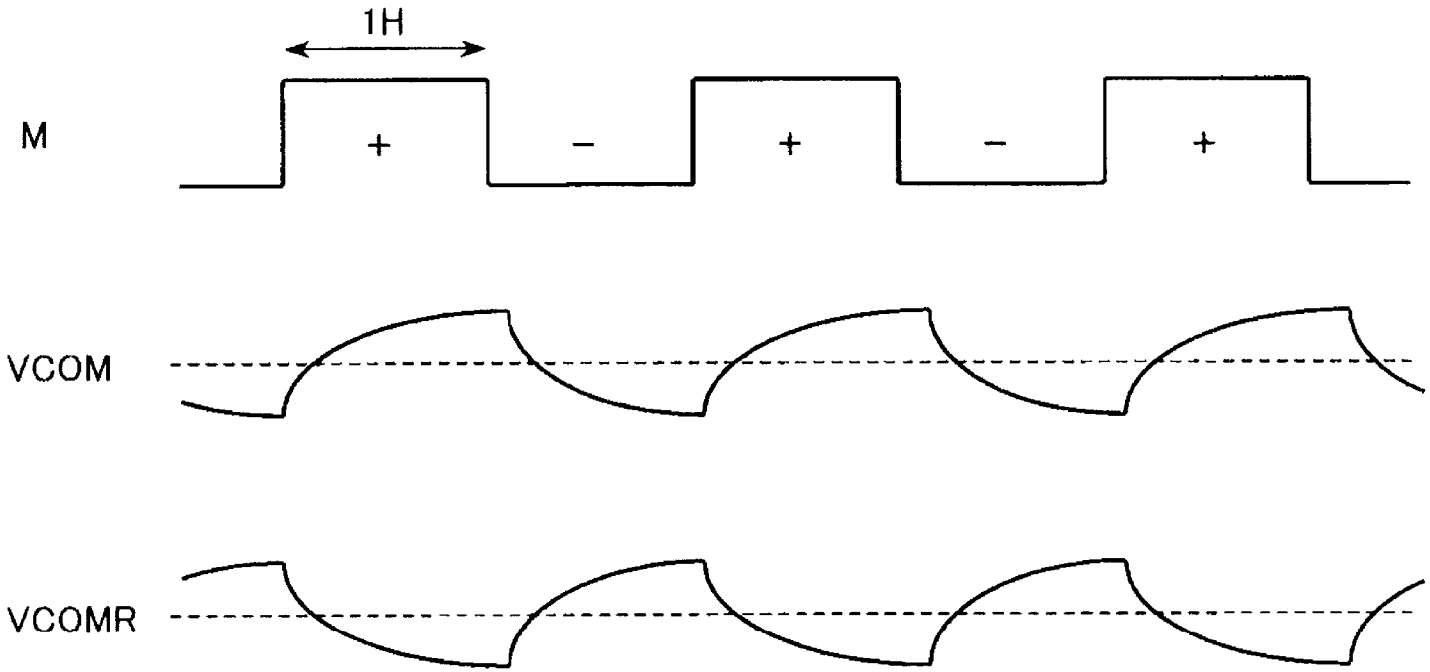
FIG. 3 is a diagram showing voltage waveforms of the alternating current signal (M), which is the control signal, and the common voltage (VCOM) applied to the counter electrodes in the present invention.

FIG. 3 is a diagram showing the voltage waveforms of an alternating current signal (M), which is a control signal in the present invention, and a common voltage (VCOM) applied to the counter electrodes (ITO2).

In FIG. 3, the alternating current signal (M) is a signal that determines the polarity of the alternating current when a gradation voltage is written into a pixel and repeats high and low during one horizontal scan period (1 H) in such a manner that a gradation voltage at a potential higher than that of the VCOM voltage is written into the odd-numbered pixels, for example, and a gradation voltage at a potential lower than that of the VCOM voltage is written into the even-numbered pixels during the high (hereinafter simply referred to as H) level period (denoted by + in FIG. 3), while a gradation voltage at a potential lower than that of the VCOM voltage is written into the odd-numbered pixels, for example, and a gradation voltage at a potential higher than that of the VCOM voltage is written into the even-numbered pixels during the low (hereinafter simply referred to as L) level period (denoted by – in FIG. 3).

In the case where an image of black-and-white vertical stripes with a width of one pixel is displayed on the liquid crystal display panel 21, the potential of the common voltage (VCOM) in the counter electrodes (ITO2) repeats upward and downward fluctuations following the polarity of the alternating current signal (M) due to the above-described distortion in the VCOM voltage, causing the screen to look green as a whole, and thus, the image quality deteriorates. In addition, when a killer pattern and a display pattern of a half-tone raster are displayed simultaneously in a complex way, the image quality deteriorates with smears being caused in the portions where the half-tone raster is displayed.

According to the present invention, a common voltage (VCOMR, hereinafter referred to as reverse correction common voltage), which is gained by superposing a reverse correction voltage for offsetting (or cancelling) the fluctuation in the potential in the counter electrodes (ITO2) on the reference common voltage, is generated in the power supply circuit 25 and supplied to the counter electrodes (ITO2) within the liquid crystal display panel 21 so as to cancel the fluctuation in the potential in the counter electrodes (ITO2). As a result, deterioration in the image quality, where the display screen of the liquid crystal display panel 21 is colored green, can be reduced so that a high quality image can be provided.

[First Embodiment]

Figure 4:
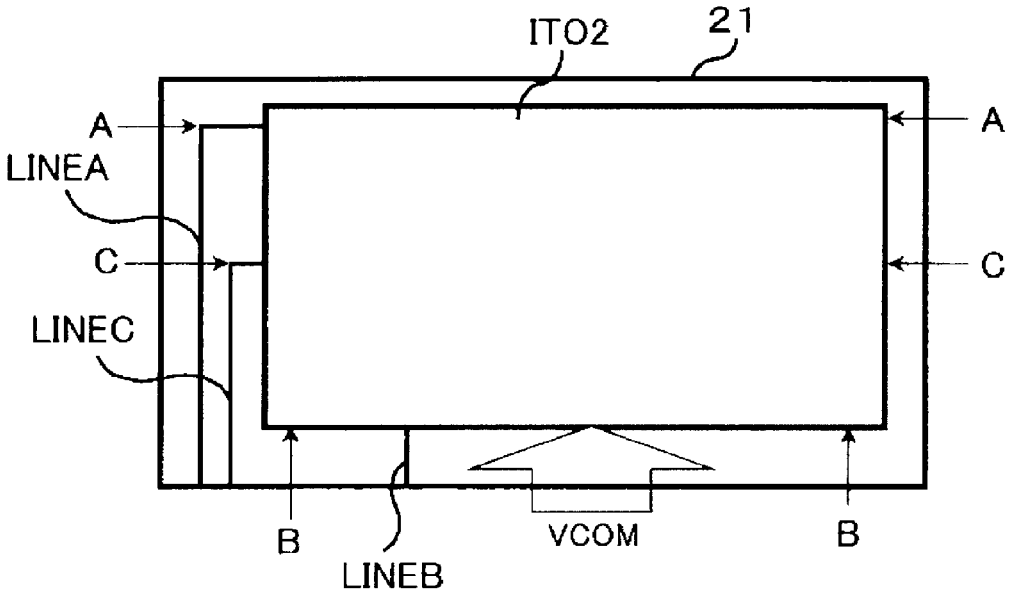
FIG. 4 is a diagram for illustrating a supplying method for supplying a common voltage to the liquid crystal display panel of the liquid crystal display device according to the first embodiment of the present invention.

FIG. 4 is a diagram for illustrating a supplying method for supplying a common voltage to the liquid crystal display panel in the liquid crystal display device according to the first embodiment of the present invention.

The counter electrode (ITO2) in FIG. 4 is rectangular in a plane, and the common voltage (VCOM) is supplied to the counter electrode (ITO2) through the bottom side (bottom side in FIG. 4) of the liquid crystal display panel 21. As viewed from the common voltage supplying end, point A in FIG. 4 is a far end portion and point B is a near end portion. Here, in the liquid crystal display panel 21 according to the present embodiment, each frame is scanned in the vertical scan direction, which is the direction from point A in the far end portion to point B in the near end portion in FIG. 4.

The greater the size of the liquid crystal display panel 21 is, the more difficult it is to ignore the resistance component from the common voltage supplying end, and thus, such a problem arises that there is a large difference in the coupling noise due to the fluctuation in the potential of the counter electrode (ITO2) between the near end portion B that is close to the common voltage supplying end and the far end portion A that is far away from the common voltage supplying end.

When the voltage that fluctuates at point A in the far end portion of the counter electrode (ITO2) is voltage A and the voltage that fluctuates at point B in the near end portion of the counter electrode (ITO2) is voltage B, the resistance component in the counter electrode (ITO2) within the liquid crystal display panel is higher as the location is further away from the common voltage supplying end, and therefore, voltage A>voltage B in terms of the amount of fluctuation in the voltage in the counter electrode (ITO2) when the liquid crystal display panel is scanned from point A to point B during the vertical scanning process.

When a killer pattern is displayed, the voltage A that fluctuates at point A in the far end portion of the counter electrode (ITO2) is higher than the voltage B that fluctuates at point B in the near end portion of the counter electrode (ITO2), and therefore, it is desired for the above-described reverse correction voltage (VCOMR) of the VCOM voltage in FIG. 3 to satisfy VCOMR A>VCOMR B. Here, VCOMR A is the reverse correction voltage at point A in the far end portion, and VCOMR B is the reverse correction voltage at point B in the near end portion.

Thus, the reverse correction voltage in the vertical scanning location is applied to the counter electrode (ITO2) in response to the voltage that fluctuates in the counter electrode (ITO2) in the liquid crystal display panel 21 so that the voltage that fluctuates in the counter electrode (ITO2) can be cancelled and the deterioration in the image quality of the killer pattern can be reduced.

Figure 5:
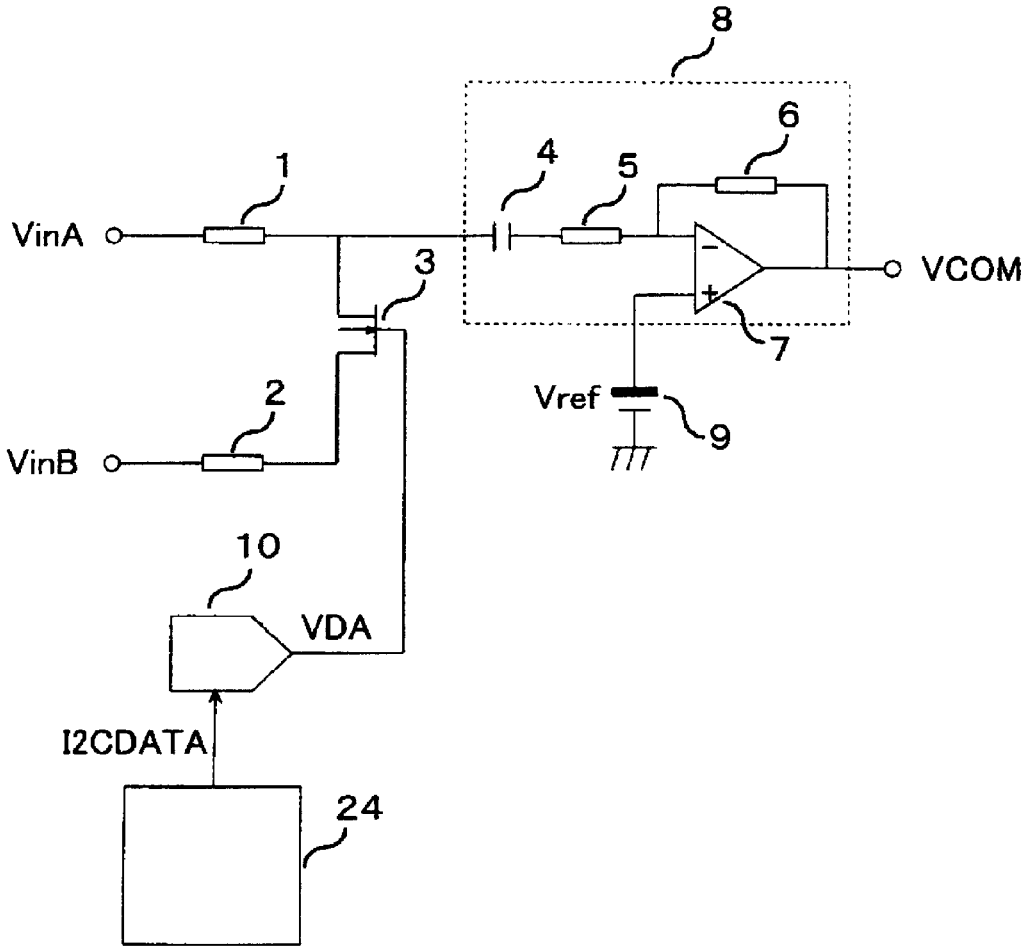
FIG. 5 is a circuit diagram showing the circuit structure of the common voltage generating circuit in the liquid crystal display device according to the first embodiment of the present invention.

FIG. 5 is a circuit diagram showing the circuit structure of the common electrode generating circuit (also referred to as VCOM generating circuit) in the liquid crystal display device according to the first embodiment of the present invention.

VinA and VinB in FIG. 5 are input signals for the VCOM generating circuit and represent, as shown in FIG. 4, the voltage that fluctuates at point A in the far end portion of the counter electrode (ITO2) and the voltage that fluctuates at point B in the near end portion of the counter electrode (ITO2) in the liquid crystal display panel 21.

VCOM in FIG. 5 is an output voltage from the VCOM generating circuit and corresponds to the voltage in the above-described VCOMR in FIG. 3, and this voltage is supplied to the counter electrode (ITO2) in the liquid crystal display panel 21.

The VCOM generating circuit in FIG. 5 is formed of a resistor 1, a resistor 2, a transistor 3 (MOS transistor, n channel field effect transistor, for example), a D/A converter 10 with a precision of 10 bits for generating the gate bias voltage applied to the transistor 3, and an inverting amplifier circuit 8.

Here, the resistor 1 is a wire resistor of the wire ranging from point A in the far end portion of the liquid crystal display panel 21 to one end the liquid crystal display panel 21 within the liquid crystal display panel 21 (LINE A in FIG. 4). The resistor 2 is a wire resistor of the wire ranging from point B in the near end portion of the liquid crystal display panel 21 to one end the liquid crystal display panel 21 within the liquid crystal display panel 21 (LINE B in FIG. 4).

The relationship in terms of the resistance value is resistor 1>resistor 2 due to the difference in the wiring distance between the wire for the resistor 1 (LINE A) and the wire for the resistor 2 (LINE B), and the resistor 1 has a value of approximately 700Ω and the resistor 2 has a value of about 10Ω.

The transistor 3 forms a mixing means in such a manner that the transistor 3 changes its internal resistance in accordance with the output signal (VDA) from the D/A converter 10 so as to change the mixture ratio of the voltage of VinA and the voltage of VinB. The output signal (VDA) from the D/A converter 10 is controlled by the display control circuit 24.

The inverting amplifier circuit 8 is formed of a fixed resistor 5, a fixed resistor 6 and an operational amplifier 7, and the reference voltage 9, Vref, is inputted into the non-inverting terminal (+) of the operational amplifier 7. The mixed voltage of the voltage VinA and the voltage VinB, which have been mixed in the transistor 3, is inputted into the inverting amplifier circuit 8 through the capacitor 4 (through a so-called alternating coupling).

The gain G of the amplification of the inverting amplifier circuit 8 can be represented by G=fixed resistance 6/fixed resistance 5, and in order to set the gain G of the amplification from several to tens of several, fixed resistance 5<fixed resistance 6 must be met. Here, even when a reverse correction voltage is applied to the common voltage supplying end of the counter electrodes (ITO2), the potential lowers at point A in the far end portion, for example, due to the resistance component of the counter electrodes (ITO2), and therefore, it is preferable for the gain G of the amplification in the inverting amplifier circuit 8 to be approximately 3. In the case where G=3, for example, fixed resistance 5=1 kΩ and fixed resistance 6=3 kΩ.

The output voltage (VCOM) from the VCOM generating circuit is as follows.

(1) In the case where the transistor 3 is in the OFF state:

$$VCOM=Vref+VinA*G$$

(2) In the case where the transistor 3 is in the process of transiting from the OFF state to the ON state:

$$VCOM=Vref+(VinA+VinB)*G$$

(3) In the case where the transistor 3 is in the ON state, where the voltage VinB having a low impedance becomes dominant due to the relationship resistance 1>resistance 2:

$$VCOM=Vref+VinB*G$$

That is to say, in the process during which the transistor 3 transits from the OFF state to the ON state, the mixture ratio of the voltage VinA and the voltage VinB changes due to the internal resistance value of the transistor 3.

This mixed voltage of the voltage VinA and the voltage VinB is amplified G times greater by the inverting amplifier circuit 8 for AC coupling so that the voltage that has been superposed with the voltage Vref, which is the DC reference voltage, becomes the reverse correction common voltage (VCOMR) that is supplied to the counter electrodes (ITO2).

Figure 6:
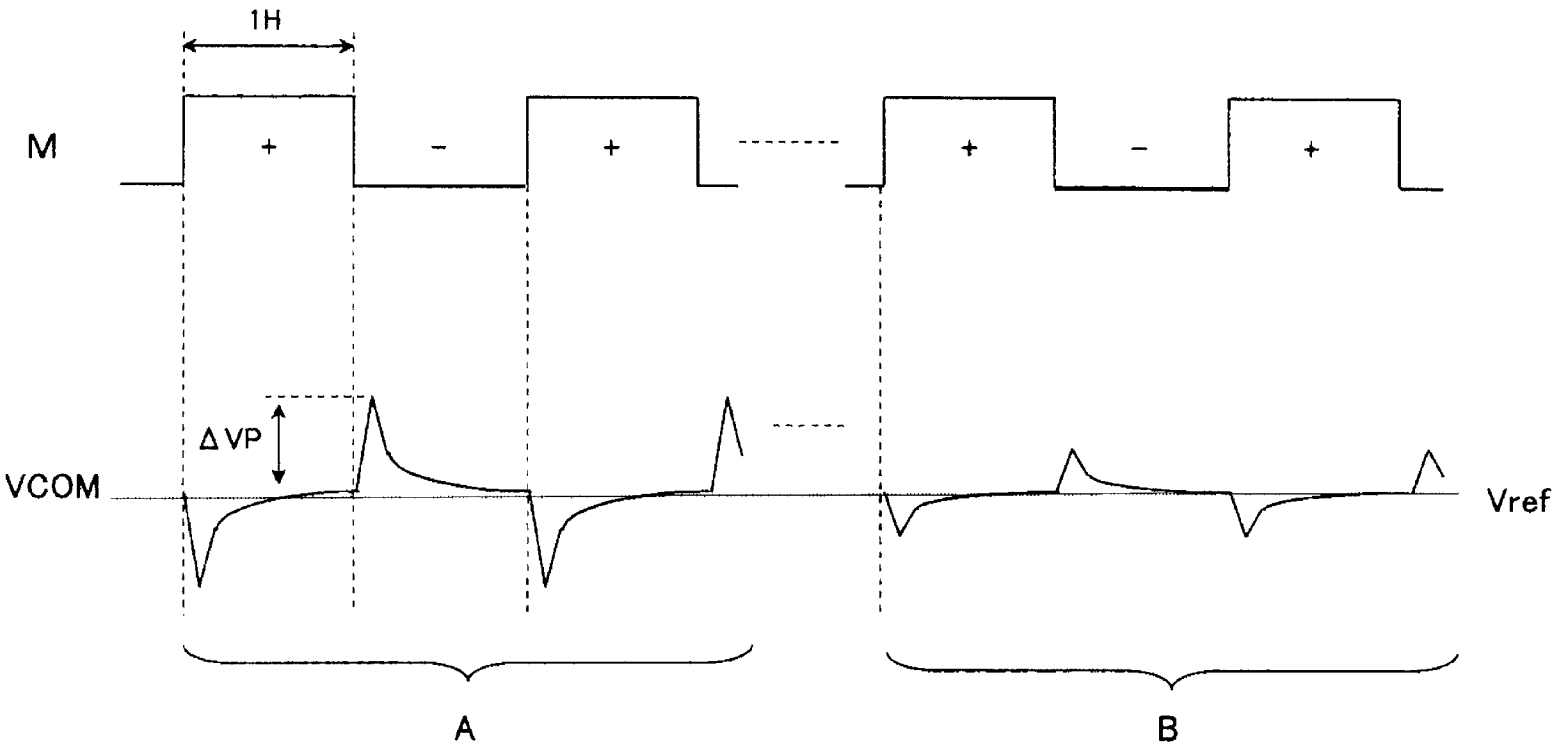
FIG. 6 is a diagram showing the waveforms of the alternating current signal (M) and the reverse correction common voltage generated in the VCOM generating circuit in the liquid crystal display device according to the first embodiment of the present invention.

FIG. 6 is a diagram showing the waveforms of the alternating current signal (M) in the liquid crystal display device according to the first embodiment of the present invention and the reverse correction common voltage generated by the VCOM generating circuit.

The alternating current signal (M) in FIG. 6 is a signal for determining the polarity of the alternating current when a gradation voltage is written into a pixel as described above with regards to FIG. 3.

The common voltage (VCOM) in FIG. 6 corresponds to the reverse correction voltage (VCOMR) in response to the voltage that fluctuates in the counter electrodes (ITO2) when the above-described killer pattern is displayed as shown in FIG. 3.

As described above with regards to FIG. 4, the voltage fluctuates greater at point A in the far end portion at a distance away from the common voltage supplying end than at point B in the near end portion close to the common voltage supplying end in the counter electrodes (ITO2) of the liquid crystal display panel 21, and therefore, it is necessary for the reverse correction voltage (VCOMR) in the vicinity of point A in the far end portion to be greater than the reverse correction voltage (VCOMR) at point B in the near end portion.

Accordingly, as the vertical scanning progresses from point A in the far end portion at a distance away from the common voltage supplying end to point B in the near end portion close to the common voltage supplying end in the above-described liquid crystal display panel 21 in FIG. 4, the amplitude (ΔVP) of the reverse correction voltage gradually becomes smaller with the reference voltage Vref at the center in the common voltage (VCOM) in FIG. 6. In the following, a technique for controlling the amplitude (ΔVP) of this reverse correction common voltage is described.

Figure 7:
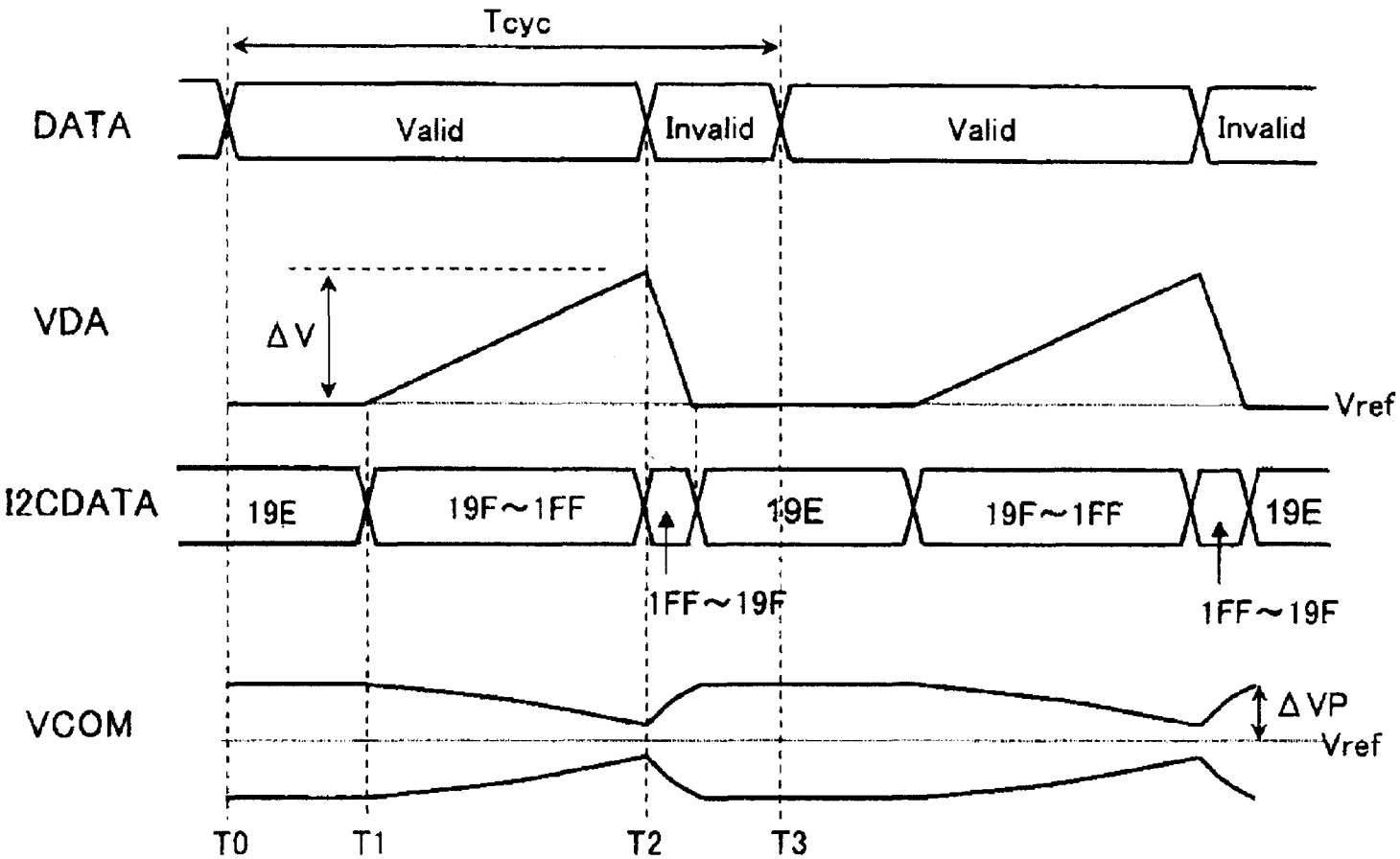
FIG. 7 is a diagram showing the timing waveforms in the common voltage generating circuit in the liquid crystal display device according to the first embodiment of the present invention.

FIG. 7 is a diagram showing the timing waveforms in the VCOM generating circuit in the liquid crystal display device according to the first embodiment of the present invention.

In FIG. 7, DATA denotes an image signal for display on the liquid crystal display panel 21 where the image data during an effective display period (T0 to T2) is shown as valid and the image data during a blank period (T2 to T3) is shown as invalid.

I2CDATA denotes a digital control signal that is sent by the display control circuit 24 to the D/A converter 10 as a signal for setting a voltage and is converted to an analog voltage by the D/A converter 10 in accordance with the digital set value of the digital control signal (I2CDATA).

The digital set value of the digital control signal (I2CDATA) is [19E] in hexadecimal notation as set data where the output of the D/A converter 10 is equal to the reference voltage of Vref from the time T0 at which the effective display period starts to the time T1 when a certain vertical scan ends. After that, whenever several tens of lines are vertically scanned from the time T1 to the time T2, the voltage set data is increased from [19E] to [19F] to [1FF], for example. Contrary to this, the voltage set data is reduced from [1FF] to [19E] during the blank period between the time T2 and the time T3.

On the basis of the digital set value of the digital control signal (I2CDATA), the D/A converter 10 generates a ramp waveform of the analog voltage VDA as shown in FIG. 7 so that the ramp voltage is applied to the transistor 3 as the gate bias voltage. Since the transistor 3 is an n channel transistor, when the voltage VDA having the ramp waveform becomes higher, the transistor 3 transits from the OFF state to the ON state following the change in the voltage.

Figure 8:
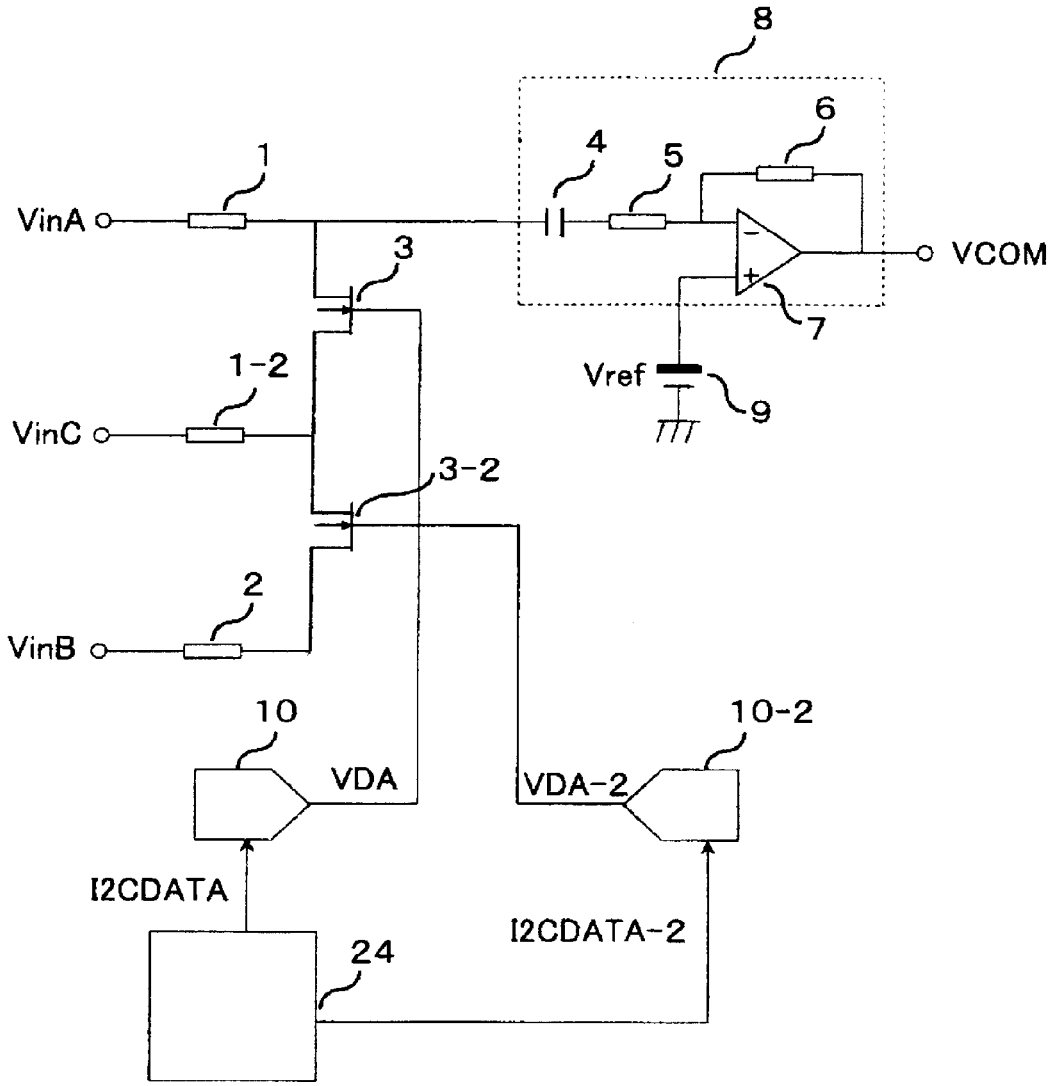
FIG. 8 is a circuit diagram showing the circuit structure of the common voltage generating circuit in the liquid crystal display device according to a modification of the first embodiment of the present invention.

In the process during which the transistor 3 transits from the OFF state to the ON state, the value of the internal resistance of the transistor 3 changes from several hundreds of MΩ to several tens of mΩ, and thus, the mixture ratio of the voltage VinA and the voltage VinB in FIG. 5 gradually shifts in relationship to VinA<VinB, and therefore, as for the reverse correction common voltage (VCOMR), the amplitude ΔVP of the reverse correction voltage gradually reduces during the effective display period from the time T1 to the time T2 as shown in FIG. 8.

When Vref=5.1 V, 200 lines are vertically scanned at the time T1, 1000 lines are vertically scanned at the time T3, and the number of steps in the vertical scanning for increasing the voltage by ΔV is 40 lines, for example, the voltage that fluctuates per step is 0.06 V, which causes a change of ΔV=1.2 V in 20 steps in a section from the time T1 to the time T2. When the D/A converter 10 has a set data of [19E] and outputs 5.1 V that is the same as the reference voltage Vref, VDA has a ramp waveform within a voltage range from 5.1 V to 6.3 V as a result of the relationship VDA=Vref+ΔV.

In the case where the direction in which each frame is scanned vertically is a direction from point B in the near end portion to point A in the far end portion in the liquid crystal display panel 21 according to the present embodiment in FIG. 4, the digital set value of the digital control signal (I2CDATA) is set so that the transistor 3 transits from the ON state to the OFF state, and as a result, the same working effects as those in the case where the direction in which each frame is scanned vertically is a direction from point A in the far end portion to point B in the near end portion in FIG. 4.

[Modification]

FIG. 8 is a circuit diagram showing the circuit structure of the VCOM generating circuit of the liquid crystal display device according to a modification of the first embodiment of the present invention.

In the modification shown in FIG. 8, the potentials that fluctuate in a counter electrode (ITO2) are offset on the basis of the potentials that fluctuate at point C in the mid-portion of the counter electrode (ITO2) in addition to point A in the far end portion and point B in the near end portion of the counter electrode (ITO2) as shown in FIG. 4.

The VCOM generating circuit in FIG. 8 is different from the VCOM generating circuit in FIG. 5 in that a resistor 1-2, a transistor (3-2) (MOS transistor, n channel field effect transistor, for example), and a D/A converter (10-2) with a precision of 10 bits for generating a gate bias voltage of the transistor (3-2) are added.

Here, the resistor 1-2 is a wire resistor wired within the liquid crystal display panel 21 from point C in the mid-portion of the liquid crystal display panel 21 to one end of the liquid crystal display panel 21 (LINE C in FIG. 4). Furthermore, due to the difference in the distance of wiring of the wire (LINE A in FIG. 4), the wire (LINE C in FIG. 4) and the wire (LINE B in FIG. 4), the resistor 1, the resistor (1-2) and the resistor 2 have resistance values in such a relationship as being resistance 1>resistance (1-2)>resistance 2.

In addition, the transistor (3-2) forms a mixing means, and thus, the transistor (3-2) changes its internal resistance using the output signal (VDA) from the D/A converter (10-2) so as to change the mixture ratio of the voltage VinA and the voltage VinC. The output signal (VDA2) from the D/A converter (10-2) is controlled by the display control circuit 24.

When the gain of the amplification in the inverting amplifier 8 is G, for example, the output voltage (VCOM) from the VCOM generating circuit in FIG. 8 is as follows.

(1) In the case where the transistor 3 and the transistor (3-2) are both in the OFF state:

$$VCOM=Vref+VinA*G$$

(2) In the case where the transistor (3-2) is in the OFF state and the transistor 3 is in the process of transiting from the OFF state to the ON state:

$$VCOM=Vref+(VinA+VinC)*G$$

(3) In the case where the transistor (3-2) is in the OFF state and the transistor 3 is in the ON state, where the voltage VinC having a low impedance is dominant due to the relationship resistance 1>resistance (1-2):

$$VCOM=Vref+VinC*G$$

(4) In the case where the transistor 3 is in the ON state and the transistor (3-2) is in the process of transiting from the OFF state to the ON state:

$$VCOM=Vref+(VinC+VinB)*G$$

(5) In the case where the transistor 3 and the transistor (3-2) are both in the ON state, where the voltage VinB having a low impedance is dominant due to the relationship resistance (1-2)>resistance 2:

$$VCOM=Vref+VinB*G$$

That is to say, in the process during which the transistor 3 transits from the OFF state to the ON state, the mixture ratio of the voltage VinA and the voltage VinC changes due to the value of the internal resistance of the transistor 3, and in the process during which the transistor (3-2) transits from the OFF state to the ON state, the mixture ratio of the voltage VinC and the voltage VinB changes due to the value of the internal resistance of the transistor (3-2).

The mixed voltage of the voltage VinA and the voltage VinC or of the voltage VinC and the voltage VinB is amplified G times greater in the inverting amplifier circuit 8 for AC coupling so as to become a reverse correction common voltage (VCOMR) so that the voltage that has been superposed with the voltage Vref, which is the DC reference voltage, is supplied to the counter electrodes (ITO2).

Figure 9:
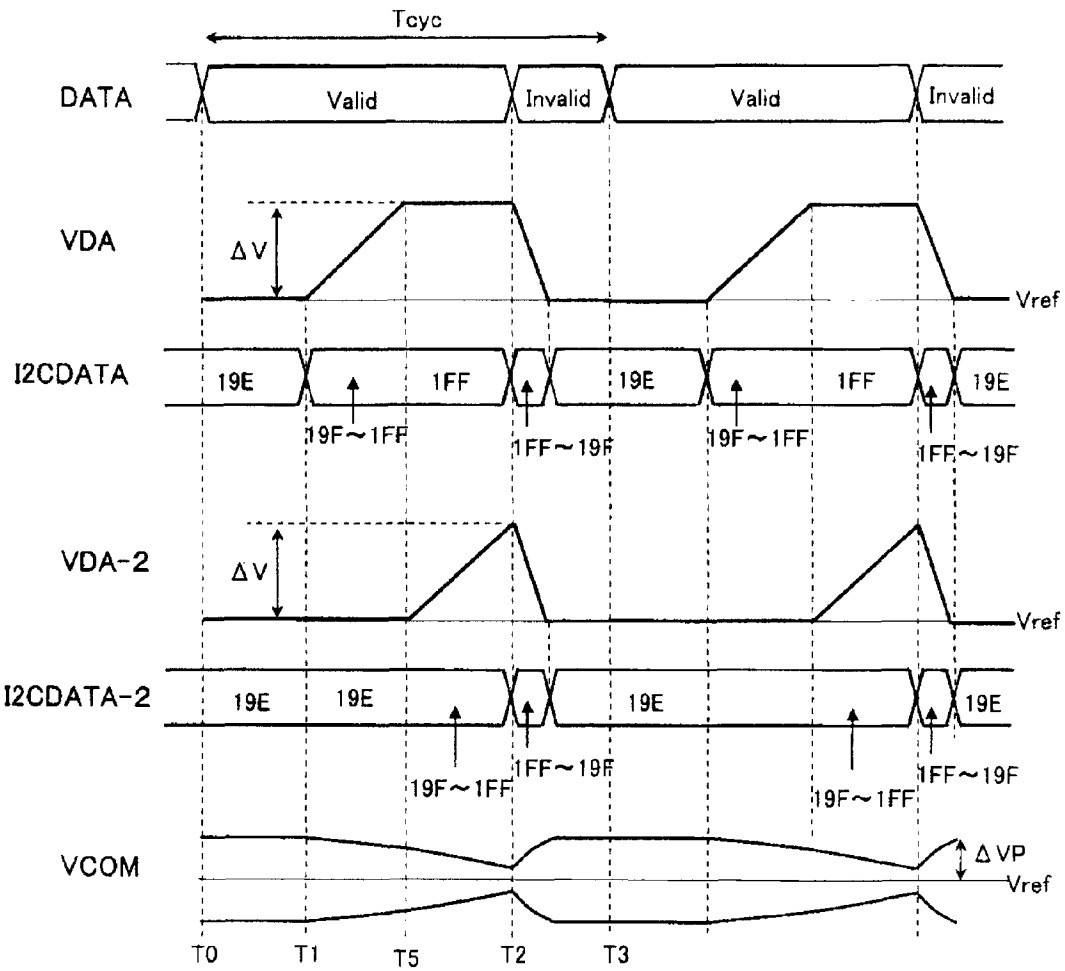
FIG. 9 is a diagram showing the timing waveforms in the common voltage generating circuit in the liquid crystal display device according to the modification of the first embodiment of the present invention.

FIG. 9 is a diagram showing the timing waveforms in the VCOM generating circuit in the liquid crystal display device according to the modification of the first embodiment of the present invention.

I2CDATA denotes the digital control signal sent by the display control circuit 24 to the D/A converter 10 as a signal for setting a voltage and is converted to an analog voltage by the D/A converter 10 in accordance with the digital set value of the digital control signal (I2CDATA).

The digital set value of the digital control signal (I2CDATA) is [19E] in hexadecimal notation as set data where the output of the D/A converter 10 is equal to the reference voltage of Vref from the time T0 at which the effective display period starts to the time T1 when a certain vertical scan ends. After that, whenever several tens of lines are vertically scanned from the time T1 to the time T5, the voltage set data is increased from [19E] to [19F] to [1FF], for example, and [1FF] is maintained between the time T5 to the time T2. Contrary to the above, the voltage set data is reduced from [1FF] to [19E] during the blank period between the time T2 and the time T3.

On the basis of the digital set value of the digital control signal (I2CDATA), the D/A converter 10 generates a ramp waveform of the analog voltage VDA as shown in FIG. 9 so that the ramp voltage is applied to the transistor 3 as the gate bias voltage. Since the transistor 3 is an n channel transistor, when the voltage VDA having the ramp waveform becomes higher, the transistor 3 transits from the OFF state to the ON state following the change in the voltage.

In the process during which the transistor 3 transits from the OFF state to the ON state, the value of the internal resistance of the transistor 3 changes from several hundreds of MΩ to several tens of mΩ, and thus, the mixture ratio of the voltage VinA and the voltage VinC in FIG. 5 gradually shifts in relationship to A<C, and therefore, as for the reverse correction common voltage (VCOMR), the amplitude ΔVP of the reverse correction voltage gradually reduces during the effective display period from the time T1 to the time T5 as shown in FIG. 9.

I2CDATA-2 denotes the digital control signal sent by the display control circuit 24 to the D/A converter (10-2) as a signal for setting a voltage and is converted to an analog voltage by the D/A converter (10-2) in accordance with the digital set value of the digital control signal (I2CDATA-2).

The digital set value of the digital control signal (I2CDATA-2) is [19E] in hexadecimal notation as set data where the output of the D/A converter (10-2) is equal to the reference voltage of Vref from the time T0 at which the effective display period starts to the time T5 when a certain vertical scan ends. After that, whenever several tens of lines are vertically scanned from the time T5 to the time T2, the voltage set data is increased from [19E] to [19F] to [1FF], for example. Contrary to the above, the voltage set data is reduced from [1FF] to [19E] during the blank period between the time T2 and the time T3.

On the basis of the digital set value of the digital control signal (I2CDATA-2), the D/A converter (10-2) generates a ramp waveform of the analog voltage VDA-2 as shown in FIG. 9 so that the ramp voltage is applied to the transistor (3-2) as the gate bias voltage. Since the transistor (3-2) is an n channel transistor, when the voltage VDA-2 having the ramp waveform becomes higher, the transistor (3-2) transits from the OFF state to the ON state following the change in the voltage.

In the process during which the transistor (3-2) transits from the OFF state to the ON state, the value of the internal resistance of the transistor (3-2) changes from several hundreds of MΩ to several tens of mΩ, and thus, the mixture ratio of the voltage VinC and the voltage VinB in FIG. 8 gradually shifts in relationship to VinC<VinB, and therefore, as for the reverse correction common voltage (VCOMR), the amplitude ΔVP of the reverse correction voltage gradually reduces during the effective display period from the time T5 to the time T2 as shown in FIG. 9.

Here, in the VCOM generating circuit in FIG. 8, it is necessary for the number of steps of the vertical scanning for increasing the voltage by ΔV to be half of that in the case of the VCOM generating circuit in FIG. 5.

[Second Embodiment]

Figure 10:
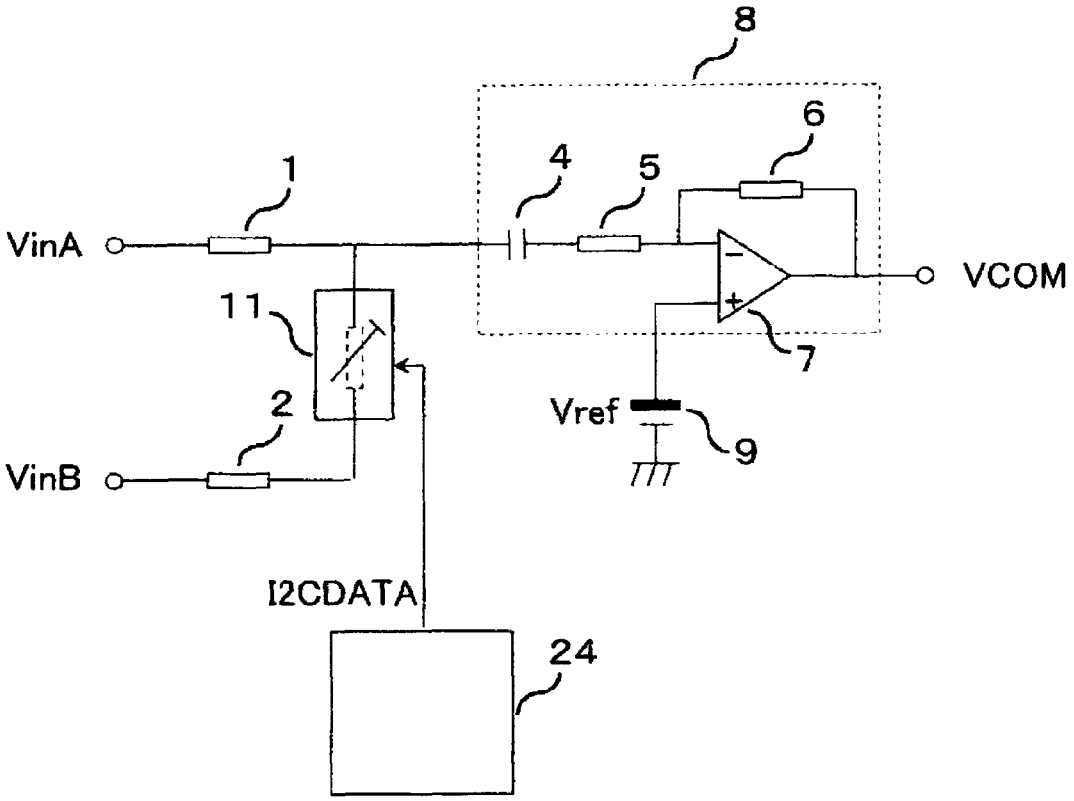
FIG. 10 is a circuit diagram showing the circuit structure of the common voltage generating circuit in the liquid crystal display device according to the second embodiment of the present invention.
Figure 11:
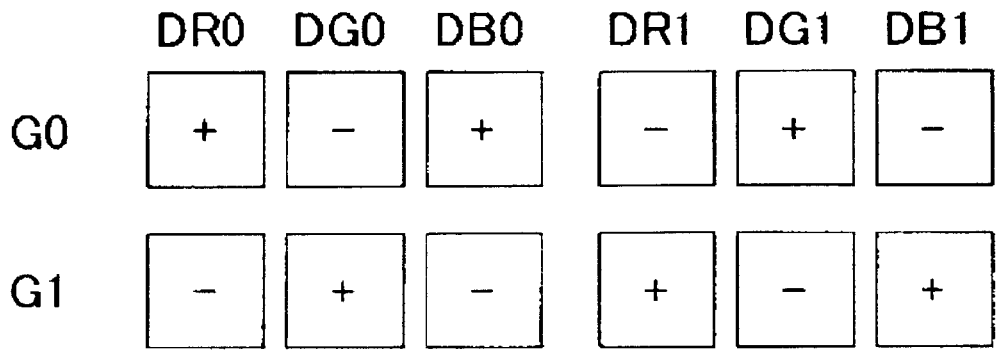
FIG. 11 is a diagram showing the polarities of the pixels in the liquid crystal display device driven in accordance with a dot inverting method.
Figure 12:
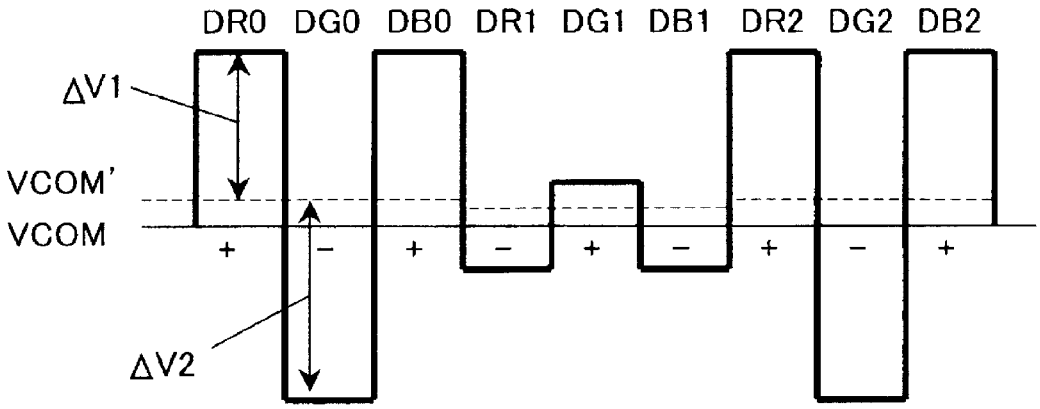
FIG. 12 is a diagram showing the potential of the gradation voltage written into the pixels when an image of black-and-white vertical stripes with a width of one dot is displayed on the liquid crystal display panel in accordance with a dot inverting driving method.

FIG. 10 is a circuit diagram showing the circuit structure of the VCOM generating circuit in the liquid crystal display device according to the second embodiment of the present invention.

The circuit structure is different from that according to the first embodiment shown in FIG. 5 in that the D/A converter 10 and the transistor 3 have been replaced with a digital control variable resistor IC (11).

The digital control variable resistor IC (11) is an IC of which the resistance value changes on the basis of the digital set data (I2CDATA) outputted from the display control circuit 24 and functions in the same manner as the D/A converter 10 and the transistor 3 in the first embodiment shown in FIG. 5.

In the case where the set data is [19F], for example, the internal resistance of the digital control variable resistor IC (11) is high, and in the case where the set data is [1FF], the internal resistance of the digital control variable resistor IC (11) is low.

The timing according to which data is sent to the digital control variable resistor IC (11) from the display control circuit 24 is the same as the I2CDATA shown in FIG. 7.

In addition, the function of changing the amplitude (ΔVP) of the reverse correction voltage in the common voltage (VCOM) supplied to the counter electrodes (ITO2) by changing the internal resistance of the above-described digital control variable resistor IC (11) is the same as described above for the operation in the first embodiment.

Though as shown in FIG. 4 a case where the counter electrodes (ITO2) are rectangular electrodes in a plane is described in the above, the present invention is not limited to this, and the counter electrodes (ITO2) may be electrodes in band form provided in the direction in which the scan lines (G) run.

In addition, the VCOM generating circuit is provided in the power supply circuit 25 shown in FIG. 1.

Furthermore, though a case where a dot inverting method is adopted as a method for driving the liquid crystal display device is described in the above, the present invention is not limited to this, and the present invention can be applied to a case where an n line (two line, for example) inverting method is adopted as a method for driving the liquid crystal display device.

Though the invention made by the present inventors is described in detail on the basis of the above-described embodiments, the present invention is not limited to the above-described embodiments, and various modifications are possible as long as the gist of the invention is not deviated from.

What is claimed is:

1. A liquid crystal display device comprising:

a liquid crystal display panel having a number of pixels;

wherein each of said pixels has a pixel electrode to which an image voltage is supplied and a counter electrode to which a common voltage is supplied; and wherein when two pixels adjacent to each other along one display line are a first pixel and a second pixel, an image voltage at a potential higher than that of the common voltage supplied to the counter electrode is applied to the pixel electrode of the first pixel and an image voltage at a potential lower than that of the common voltage supplied to the counter electrode is applied to the pixel electrode of the second pixel when the image voltage is written into the pixel electrode;

a common voltage generating circuit for generating a common voltage supplied to each of the counter electrodes of said pixels;

a feedback means for detecting a fluctuation in the potential of the common voltage in a number of places within each of said counter electrodes so that the fluctuation is fed back to said common voltage generating circuit; and a supply end for supplying said common voltage to each of said counter electrodes from said common voltage generating circuit, characterized in that on the basis of a fluctuation in the potential that has been fed back by said feedback means, said common voltage generating circuit supplies a common voltage that is gained by superposing a reverse correction voltage for offsetting said fluctuation in the potential on a reference common voltage, which is a common voltage before said fluctuation in the potential is fed back, to the counter electrode; and when point A is located at a distance away from said supply end and point B is located closer to said supply end than point A, the voltage that fluctuates at said point A is voltage A and the voltage that fluctuates as said point B is voltage B, said feedback means detects fluctuations in the potential in two places for said voltage A and said voltage B so that the fluctuations are fed back to said common voltage generating circuit.

2. The liquid crystal display device according to claim 1, characterized in that said common voltage generating circuit has a mixing means for mixing said voltage A and said voltage B and an amplifier circuit for inverting and amplifying the voltage mixed in said mixing means so that the resulting voltage is superposed on said reference common voltage and is supplied to said counter electrodes.

3. The liquid crystal display device according to claim 2, characterized in that the direction in which said liquid crystal display panel is scanned vertically is the direction from said point A toward said point B, and said mixing means continuously changes the mixture ratio of said voltage A and said voltage B in such a manner that said voltage A and said voltage B are mixed when having such a relationship as voltage A >voltage B at the beginning of one vertical scan period, and said voltage A and said voltage B are mixed when having such a relationship as voltage A<voltage B as the vertical scan period progresses.

4. The liquid crystal display device according to claim 3, characterized in that said mixing means has a resistor A where said voltage A is inputted at one end, a resistor B where said voltage B is inputted at one end, and a transistor connected between the other end of said resistor A and the other end of said resistor B, the resistance value of said resistor A is higher than the resistance value of said resistor B, said voltage A is inputted into said amplifier circuit through resistor A, said voltage B is inputted into said amplifier circuit through said resistor B and said transistor, and the mixture ratio of said voltage A and said voltage B is changed by changing the gate voltage of said transistor.

5. The liquid crystal display device according to claim 4, characterized in that said mixture means has a D/A converting circuit for converting the inputted digital control signal into an analog control signal and for inputting the converted analog control signal into the gate of said transistor, and the mixture ratio of said voltage A and said voltage B is changed by changing the gate voltage of said transistor in accordance with the change in said inputted digital control signal.

6. The liquid crystal display device according to claim 5, further comprising a display control circuit and a power supplying circuit, characterized in that said common voltage generating circuit is provided within said power supplying circuit, and said display control circuit generates a digital control signal, which is inputted into said common voltage generating circuit within said power supplying circuit.

7. The liquid crystal display device according to claim 3, characterized in that said mixing means has a resistor A where said voltage A is inputted at one end, a resistor B where said voltage B is inputted at one end, and a digital control variable resistor which is connected between the other end of said resistor A and the other end of said resistor B and into which said digital control signal is inputted, the resistance value of said resistor A is greater than the resistance value of said resistor B, said voltage A is inputted into said amplifier circuit through said resistor A, said voltage B is inputted into said amplifier circuit through said resistor B and said digital control variable resistor, and the mixture ratio of said voltage A and said voltage B is changed by changing the resistance value of said digital control variable resistor in accordance with the change in said inputted digital control signal.

8. The liquid crystal display device according to claim 2, characterized in that the direction in which said liquid crystal display panel is scanned vertically is the direction from said point A toward said point B, and said mixing means continuously changes the mixture ratio of said voltage A and said voltage B in such a manner that said voltage A and said voltage B are mixed when having such a relationship as voltage A >voltage B at the beginning of one vertical scan period, and said voltage A and said voltage B are mixed when having such a relationship as voltage A <voltage B as the vertical scan period approaches the end.

* * * * *